US006690342B2

(12) United States Patent
Yamamoto et al.

(10) Patent No.: US 6,690,342 B2
(45) Date of Patent: Feb. 10, 2004

(54) PLASMA DISPLAY DEVICE

(75) Inventors: Ken-ichi Yamamoto, Higashimurayama (JP); Hiroshi Kajiyama, Hitachi (JP); Keizo Suzuki, Kodaira (JP); Yoshimi Kawanami, Miyazaki (JP); Masayuki Shibata, Miyazaki (JP); Yasuhiko Kunii, Miyazaki (JP)

(73) Assignees: Hitachi, Ltd., Tokyo (JP); Fujitsu Hitachi Plasma Display Limited, Kawasaki (JP)

( * ) Notice: Subject to any disclaimer, the term of this patent is extended or adjusted under 35 U.S.C. 154(b) by 300 days.

(21) Appl. No.: 09/793,902

(22) Filed: Feb. 28, 2001

(65) Prior Publication Data

US 2002/0060651 A1 May 23, 2002

(30) Foreign Application Priority Data

Nov. 21, 2000 (JP) ..... 2000-354676

(51) Int. Cl.[7] ..... G09G 3/28

(52) U.S. Cl. ..... 345/60; 315/169.4

(58) Field of Search ..... 345/60–63, 66, 345/68, 74.1, 76; 315/167, 168, 169.1, 169.4; 313/484, 491, 514, 517, 520

(56) References Cited

U.S. PATENT DOCUMENTS

| | | | | | |
|---|---|---|---|---|---|
| 6,028,573 | A | * | 2/2000 | Orita et al. | 345/66 |
| 6,034,482 | A | * | 3/2000 | Kanazawa et al. | 315/169.4 |
| 6,111,556 | A | * | 8/2000 | Moon | 345/60 |
| 6,376,995 | B1 | * | 4/2002 | Kato et al. | 315/169.3 |
| 6,448,946 | B1 | * | 9/2002 | Anderson et al. | 345/60 |
| 6,483,250 | B1 | * | 11/2002 | Hashimoto et al. | 315/169.4 |
| 6,483,490 | B1 | * | 11/2002 | Lo | 345/60 |

* cited by examiner

*Primary Examiner*—Vijay Shankar
*Assistant Examiner*—Mansour M. Said
(74) *Attorney, Agent, or Firm*—Antonelli, Terry, Stout & Kraus, LLP

(57) ABSTRACT

A plasma display device includes a plasma display panel having a pair of opposing base plates and plural discharge cells formed between the base plates, and a driving circuit for driving the discharge cells. Each discharge cell has a pair of discharge sustain electrodes disposed on one of the base plates and an address electrode disposed on another of the base plates. At least one of the pair of discharge sustain electrodes is supplied with a pulse drive voltage within a period of light emission of a corresponding one of the plural discharge cells, and an address electrode of at least one of the plural discharge cells is supplied with a driving voltage within the period of light emission, and the drive voltage has a waveform where an absolute value of the voltage level Vb is not greater than an absolute value of half the voltage level Va.

10 Claims, 18 Drawing Sheets

PLASMA DISPLAY DEVICE

BACKGROUND OF THE INVENTION

The present invention relates to a plasma display device employing a plasma display panel (hereinafter referred to as a PDP), and in particular to a technology useful for increasing luminous efficiency.

Recently, plasma display devices employing an AC surface-discharge PDP are beginning to be mass-produced as a large-screen thin color display devices.

Presently, AC surface-discharge PDPs having a three-electrode structure as shown in FIG. 13 are widely used. In the AC surface-discharge PDP of FIG. 13, a discharge space 33 is formed between a pair of opposing glass base plates, a front base plate 21 and a rear base plate 28. The discharge space 33 is filled with a discharge gas (usually a mixture of gases such as He, Ne, Xe, Ar and others) at several hundreds or more of Torrs.

A plurality of pairs of X and Y electrodes for sustain discharge are disposed on the underside of the front base plate 21 serving as a display screen, for sustain discharge mainly for light emission for forming a display.

Usually, each of the X and Y electrodes is made of a combination of a transparent electrode and an opaque electrode to supplement conductivity of the transparent electrode.

The X electrodes are comprised of transparent X electrodes 22-1, 22-2, . . . and corresponding opaque X bus electrodes 24-1, 24-2, . . . , respectively, and the Y electrodes are comprised of transparent Y electrodes 23-1, 23-2, . . . and corresponding opaque Y bus electrodes 25-1, 25-2, . . . , respectively. It is often that the X electrodes are used as a common electrode and the Y electrodes are used as independent electrodes.

A discharge gap Ldg between the X and Y electrodes in one discharge cell are designed to be small such that a discharge breakdown voltage is not excessively high, and a spacing Lng between two adjacent cells is designed to be large such that unwanted discharge is prevented from occurring between two adjacent cells.

The discharge sustain X and Y electrodes are covered with a front dielectric substance 26 which, in turn, is covered with a protective film 27 made of material such as magnesium oxide (MgO).

The MgO protects the front dielectric substance 26 and lowers a discharge breakdown voltage because of its low sputtering yield and high secondary electron emission coefficient.

Address electrodes 29 (hereinafter referred to merely as an A-electrode) for addressing cells are disposed on the upper surface of the rear base plate 28 in a direction perpendicularly to the discharge sustain X and Y electrodes.

The address electrodes 29 are covered with a rear dielectric substance 30, separation walls 31 are disposed between the A-electrodes on the rear dielectric substance 30.

A phosphor 32 is coated in a cavity formed by the surfaces of the separation walls 31 and the upper surface of the rear dielectric substance 30.

In this configuration, an intersection of a pair of discharge sustain electrodes with an A-electrode corresponds to one discharge cell, and the discharge cells are arranged in a two-dimensional fashion.

In a color PDP, a trio of three discharge cells coated with red, green and blue phosphors, respectively, forms one pixel.

FIG. 14 and FIG. 15 are cross-sectional views of one discharge cell of FIG. 13 viewed in the directions of the arrows D1 and D2, respectively. In FIG. 15, the boundary of the cell is approximately represented by broken lines.

Now operation of the PDP will be explained.

The principle of generation of light by the PDP is such that discharge is started by a pulse applied between the X and Y electrodes, and ultraviolet rays generated by excited discharge gases are converted into visible light by the phosphor.

As shown in a block diagram of FIG. 16, the PDP 100 is incorporated into a plasma display device 102.

In FIG. 16, a driving circuit 101 receives signals for a display image from a video signal source 103, converts the signals into driving voltages as shown in FIGS. 17A to 17C, and then supplies them to respective electrodes of the PDP 100.

FIG. 17A is a time chart illustrating a driving voltage during one TV field required for displaying one picture on the PDP shown in FIG. 13. Portion of FIG. 17A illustrates that one TV field 40 is divided into sub-fields 41 to 48 having different numbers of light emission more than one from one another. Gray scales are generated by a combination of one or more selected from among the eight sub-fields.

Suppose eight sub-fields are provided which have gray scale brightness steps in binary number step increments, then each discharge cell of a three-primary color display device provides $2^8$ (=256) gray scales, and as a result the three-primary color display device is capable of displaying about 16.78 millions of different colors.

Portion II of FIG. 17A illustrates that each sub-field comprises a reset discharge period 49 for resetting a discharge cell to an initial state, an address period 50 for addressing a discharge cell to be made luminescent, and a light-emission period (also called a discharge sustain period) 51.

FIG. 17B illustrates waveforms of voltages applied to the A-electrode 29, the X electrode and the Y electrode during the address period 50 shown in FIG. 17A. A waveform 52 represent a voltage V0 applied to one of the A-electrodes 29, a wave form 53 represent a voltage V1 applied to the X electrode, and waveforms 54 and 55 represent voltages V21 and 22 applied to ith and (i+1)st Y electrodes.

As shown in FIG. 17B, when a scan pulse 56 is applied to the ith Y electrode, in a cell located at an intersection of the ith Y electrode with the A-electrode 29 supplied with the voltage V0, first an address discharge occurs between the Y electrode and the A-electrode, and then an address discharge occurs between the Y electrode and the X electrode.

No address discharges occur at cells located at intersections of the X and Y electrodes with the A-electrode at ground potential.

The above applies to a case where a scan pulse 27 is applied to the (i+1)st Y electrode.

In the cell where the address discharges have occurred, charges (wall discharges) are generated on the surface of the dielectric substance 26 and the protective film 27 covering the X and Y electrodes by the discharges, and consequently, a wall voltage Vw (V) occurs between the X and Y electrodes as shown in FIG. 15.

In FIG. 15, reference numeral 3 denotes electrons, 4 is a positive ion, 5 is a positive wall charge, and 6 are negative wall charges.

The presence and absence of the wall charges corresponds to the presence and absence of sustain discharge during the succeeding light-emission period 51, respectively.

FIG. 17C illustrates pulse driving voltages (or voltage pulses) applied to the X and Y electrodes serving to sustain discharge and a driving voltage applied to the A-electrode, all at the same time during the light-emission period 51 shown in FIG. 17A.

The Y electrode is supplied with a pulse driving voltage of waveform 58, the X electrode is supplied with a pulse driving voltage of waveform 59, the magnitude of the voltages of the waveforms 58 and 59 being V3(V).

The A-electrode 29 is supplied with a driving voltage of waveform 60 which is kept at a constant voltage V4 during the light-emission period 51. The voltage V4 may be ground potential.

The pulse driving voltage of the magnitude V3 is applied alternately to the X electrode and the Y electrode, and as a result reversal of the polarity of the voltage between the X and Y electrodes is repeated.

The magnitude V3 is selected such that the presence and absence of the wall voltage generated by the address discharge correspond to the presence and absence of the sustaining discharge, respectively.

In the discharge cell where the address discharge has occurred, discharge is started by the first voltage pulse, and continues until wall charges of the opposite polarity accumulate to some extent.

The wall voltage accumulated due to this discharge serves to reinforce the second inverted voltage pulse, and then discharge is started again.

The above is repeated by the third and succeeding pulses.

In this way, in the discharge cell where the address discharge has occurred, sustain discharges occur between the X and Y electrodes the number of times equal to the number of the applied voltage pulses and emit light. On the other hand, the discharge cells do not emit light where the address discharge has not occurred.

At present, efficiency of luminescence of the PDP is inferior to that of a cathode ray tube, and therefore improvement of the efficiency of the PDP is necessary so that the PDPs spread as TV receivers.

There is also a problem in that, in realization of a large-screen PDP, a current to be supplied to its electrodes increases excessively and the power consumption increases.

When the size of the cell is reduced in order to increase the number of pixels and thereby increase the degree of definition of a display image, there is also a problem in that the efficiency of luminescence is reduced because of the reduction of the discharge space.

The improvement of luminous efficiency of the PDP is essential for solving the above problems.

Conventional techniques for improving the luminous efficiency include improvements of cell structures and driving methods.

For the improvement of cell structures, the improvements on the size or the shape of discharge sustain electrodes are disclosed in Japanese Patent Application Laid-open Nos. Hei 8-22772, Hei 3-187125, and Hei 8-315735. The improvements on material of the dielectric substance covering the discharge sustain electrode are disclosed in Japanese Patent Application Laid-open Nos. Hei 7262930 and Hei 8-315734. Some of the above have been put to practical use, but the luminous efficiency of the PDP is still inferior to that of a cathode ray tube.

For the improvement of a driving method, a method using a high frequency discharge is disclosed in IDW 1999 (Proceedings of the Sixth International Display Workshops), p. 691, but the day is still far off when this method can be put to practical use because of great dimensions of a required high frequency power source.

As described above, in the currently dominant three-electrode AC surface-discharge PDP, cell structures and driving methods have been improved for increasing the luminous efficiency.

There have been problems in that some of the above suggested improvements on the cell structures have been put to practical use, but the efficiency of luminescence of the PDP is still inferior to that of a cathode ray tube, and in that the improvement on the driving method by using a high frequency discharge has a difficulty in putting it to practical use because of the great dimensions of a required high frequency power source.

SUMMARY OF THE INVENTION

The present invention has been made to solve the above problems with the prior art, and it is an object of the present invention to provide a technology capable of improving the efficiency of sustain discharge in a plasma display device employing a plasma display panel by improving a driving method without the need for a huge high-frequency power source or the like.

The above and other objects and novel features of the present invention will be apparent from the description and the accompanying drawings.

The following explains briefly the summary of the representative ones of the present inventions disclosed in this specification:

In accordance with an embodiment of the present invention there is provided a plasma display device comprising: a plasma display panel having a pair of opposing base plates and a plurality of discharge cells formed between the pair of opposing base plates, each of the plurality of discharge cells having a pair of discharge sustain electrodes disposed on one of the pair of opposing base plates and an address electrode disposed on another of the pair of opposing base plates; and a driving circuit for driving the plurality of discharge cells, the driving circuit being configured such that at least one of the pair of discharge sustain electrodes is supplied with a pulse driving voltage within a period of light emission of a corresponding one of the plurality of discharge cells, an address electrode of at least one of the plurality of discharge cells is supplied with a driving voltage within the period of light emission, the driving voltage having a waveform including a portion varying to a voltage level Va in synchronism with variation from a first voltage level to a second voltage level of the pulse driving voltage and then varying to a voltage level Vb before the pulse driving voltage varies from the second voltage level to the first voltage level, an absolute value of the voltage level Vb not being greater than an absolute value of half the voltage level Va.

In accordance with another embodiment of the present invention, there is provided a plasma display device comprising: a plasma display panel having a pair of opposing base plates and a plurality of discharge cells formed between the pair of opposing base plates. Each of the plurality of discharge cells has a pair of discharge sustain electrodes disposed on one of the pair of opposing base plates and an address electrode disposed on another of the pair of opposing base plates; an inductance element connectable in series with the address electrode; and a driving circuit for driving the plurality of discharge cells, the driving circuit being configured such that at least one of the pair of discharge sustain electrodes is supplied with a pulse driving voltage within a period of light emission of a corresponding one of the plurality of discharge cells.

In accordance with another embodiment of the present invention, there is provided a plasma display device comprising: a plasma display panel having a pair of opposing base plates and a plurality of discharge cells formed between the pair of opposing base plates, each of the plurality of discharge cells having a pair of discharge sustain electrodes disposed on one of the pair of opposing base plates and an address electrode disposed on another of the pair of opposing base plates; a driving circuit for driving the plurality of discharge cells, the driving circuit being configured such that at least one of the pair of discharge sustain electrodes is supplied with a pulse driving voltage within a period of light emission of a corresponding one of the plurality of discharge cells; and a waveform generator for supplying to the address electrode a voltage varying in synchronism with the pulse driving voltage during at least a portion of the period of light emission.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

Figures 1A, 1B:
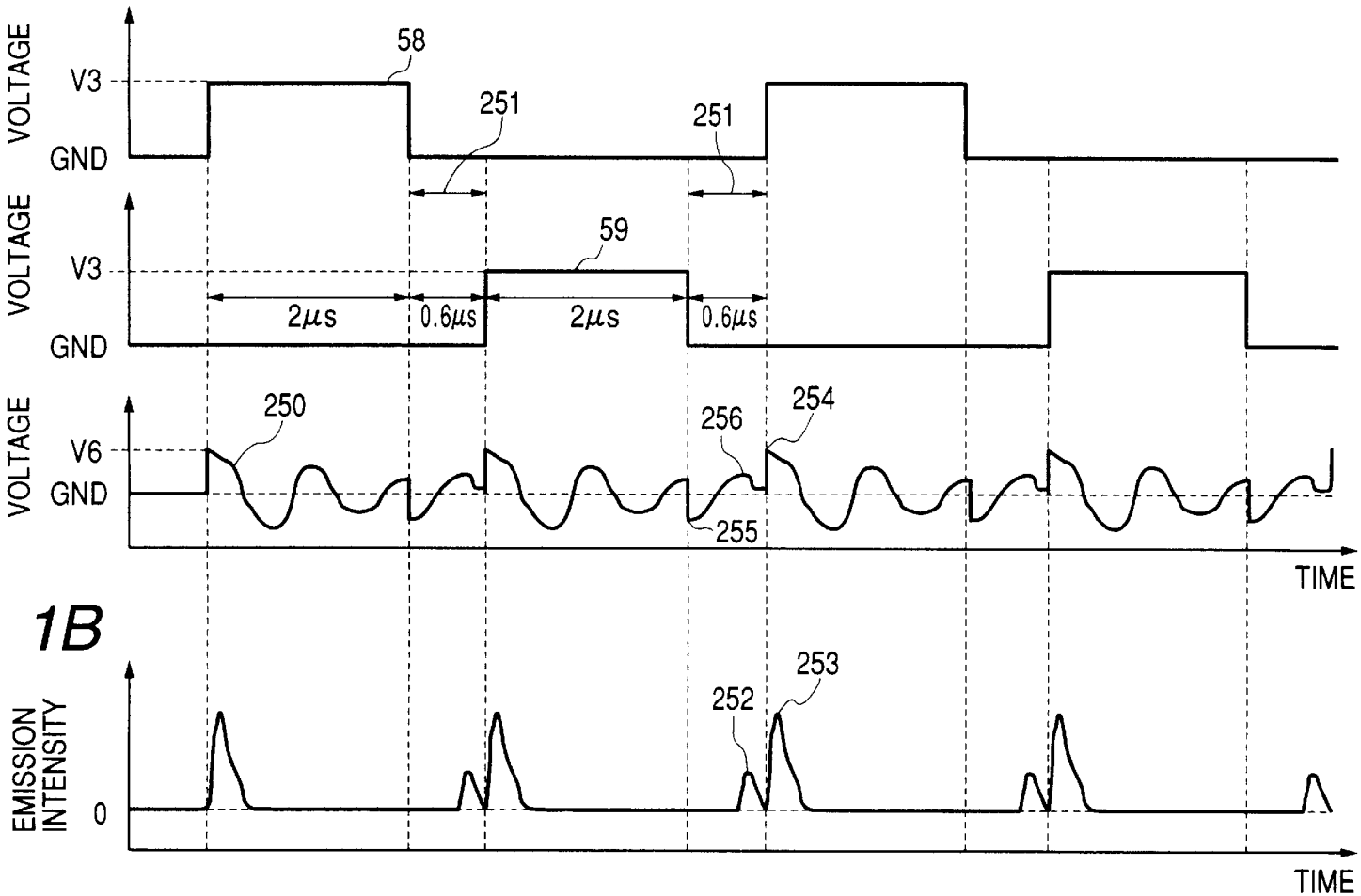
FIG. 1A illustrates a voltage sequence for a PDP of a plasma display device in accordance with Embodiment 1 of the present invention.
FIG. 1B illustrates a waveform of Xe 823 nm light emission (light emission of 823 nm in wavelength from excited Xe elements)

Now the embodiments of the present invention will be explained in detail by reference to the drawings. All the drawings for the embodiments use the same reference numerals to identify parts performing the same functions, which are not repeatedly explained in the specification.

Embodiment 1

FIG. 1A illustrates a voltage sequence for a PDP of a plasma display device in accordance with Embodiment 1 of the present invention, and FIG. 1B illustrates a waveform of Xe 823 nm light emission (light emission of 823 nm in wavelength from excited Xe elements).

Figure 2A:
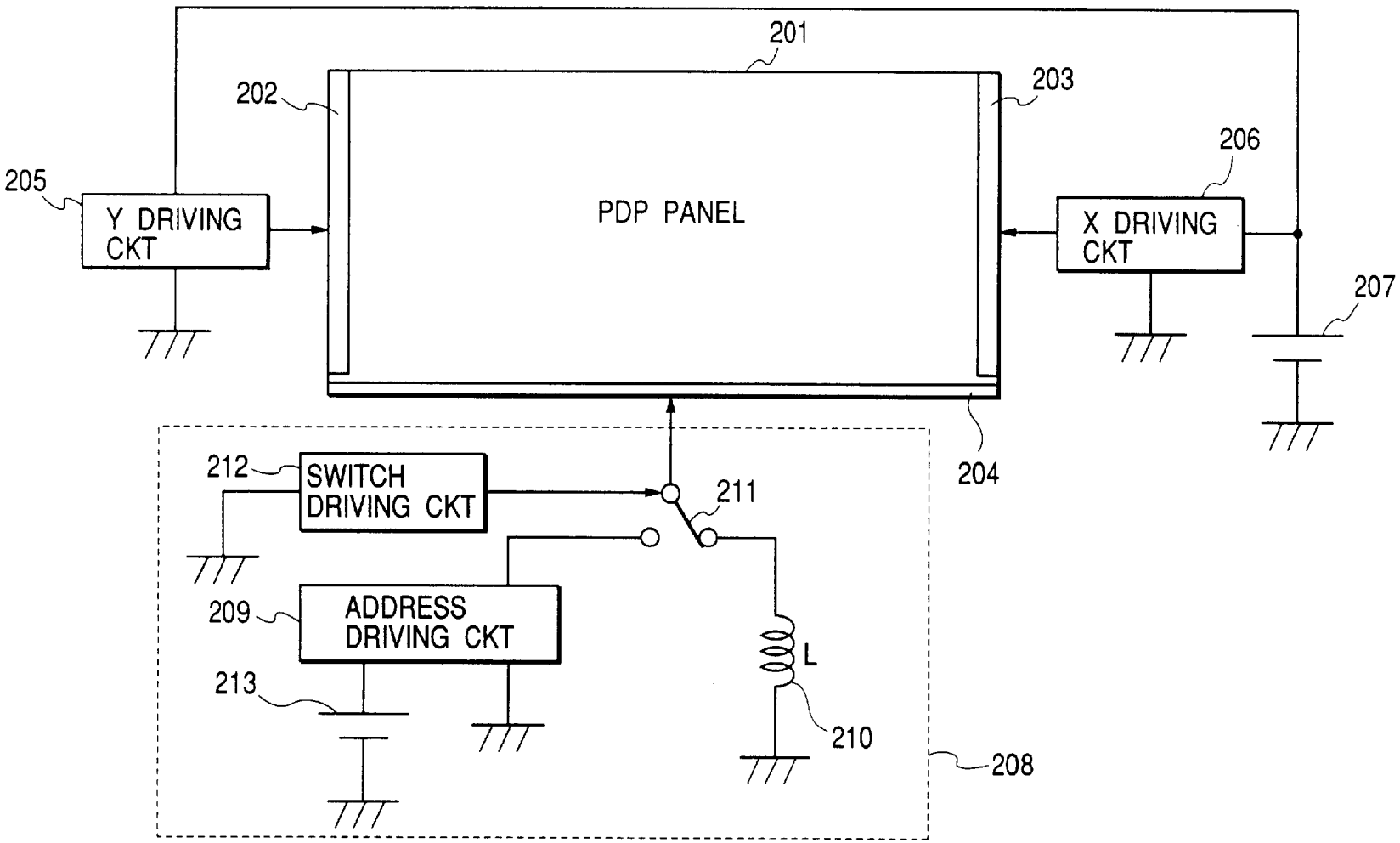
FIG. 2A is a block diagram illustrating a rough configuration of a plasma display device of Embodiment 1 of the present invention.

FIG. 2A is a block diagram illustrating a rough configuration of the plasma display device of Embodiment 1 of the present invention. In FIG. 2A and succeeding figures, lines for supply voltages for driving circuits are omitted.

As shown in FIG. 2A, the plasma display device of Embodiment 1 comprises the PDP 201, a Y-electrode terminal portion 202, an X-electrode terminal portion 203, an A-electrode terminal portion 204, a Y driving circuit 205, an X driving circuit 206, a power supply 207 for supplying voltages and powers to the Y and X driving circuits 205, 206, and an A-power source driving section 208.

The A-power source driving section 208 comprises an address driving circuit 209, an inductance element 210 (hereinafter referred to merely as a coil) having an inductance L, a switch 211 for switching between the address driving circuit 209 and the coil 210 at specified times, a switch driving circuit 212 for controlling the switch 211, and a power supply 213 for supplying voltages and powers to the address driving circuit 209.

Figure 2B:
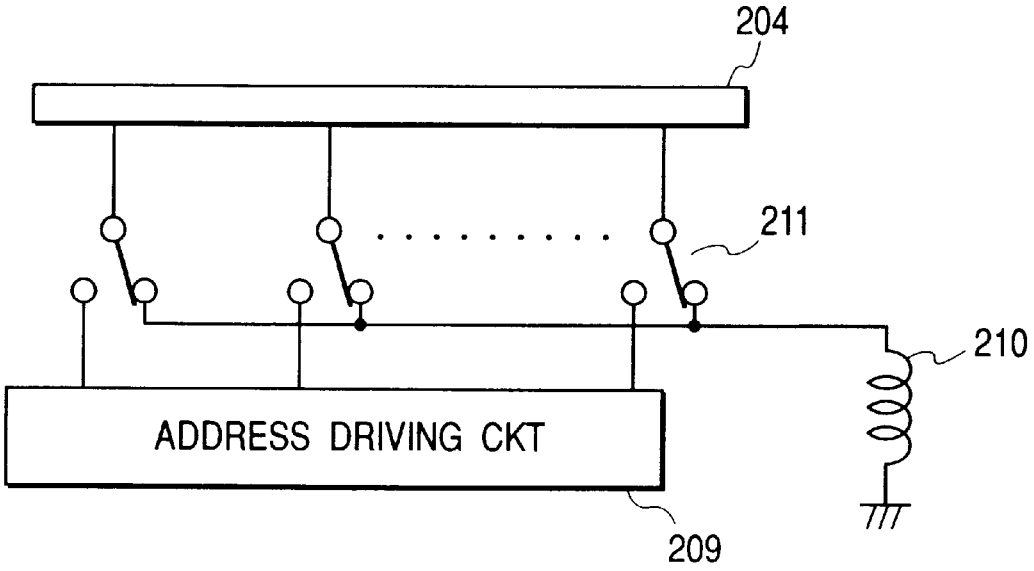
FIGS. 2B and 2C are circuit configurations of Embodiment 1 for a single inductance element and plural inductance elements, respectively.
Figure 2C:
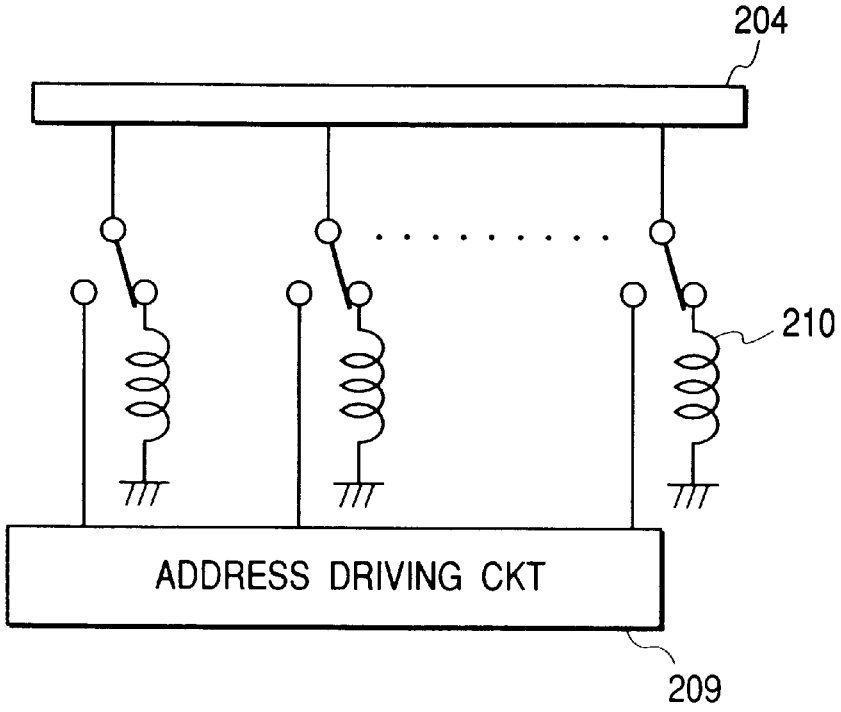

The coil 210 in FIG. 2A is one for all the A-electrodes 29 in common as shown in FIG. 2B, one coil 210 may be provided for each of the A-electrodes 29 as shown in FIG. 2C, or the A-electrodes may be divided into plural groups each including plural A-electrodes 29, and then one coil 29 may be provided for each of the plural groups.

Differences between the plasma display device of Embodiment 1 and a conventional plasma display device are as follows.

Figure 17A:
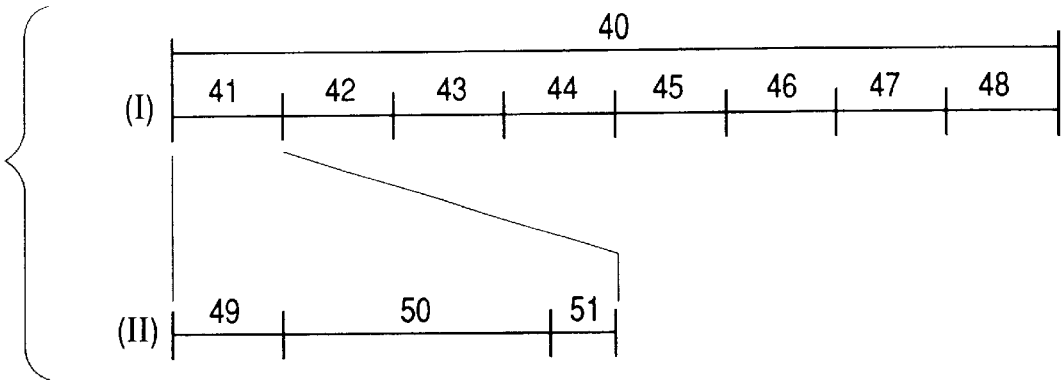
FIGS. 17A to 17C are illustrations for explaining the operation of a driving circuit during one TV field period for displaying one picture on a PDP of the prior art plasma display device.
Figure 17B:
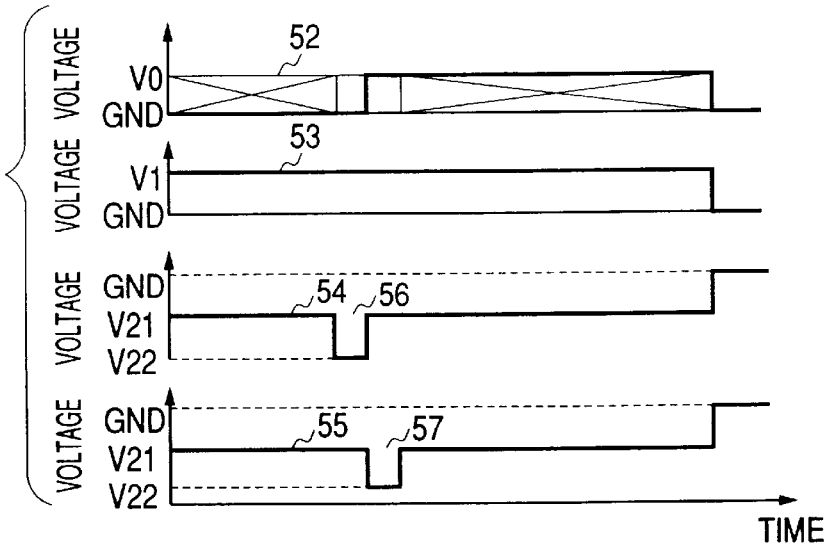
Figure 17C:
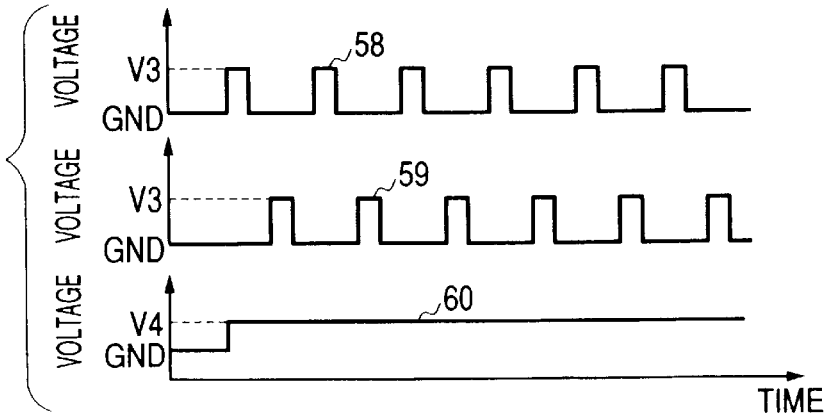

In the prior art, the A-electrode 29 is supplied with a constant voltage V4 of waveform 60 within the light-emission period 51 as shown in FIG. 17C.

On the other hand, in Embodiment 1 of the present invention, as shown in FIG. 1A, the A-electrode 29 is supplied with a voltage having a peak value of a voltage V6, oscillating with ground potential as a center and decaying with time.

As for a circuit configuration, as shown in FIG. 2A, Embodiment 1 differs from the prior art, in that the switch 211 is connected to the coil 210 within the light-emission period 51 and consequently, the A-electrode 29 is connected to ground via the coil 210 within the light-emission period 51.

Next, a driving method of the plasma display device of Embodiment 1 will be explained by referring to FIG. 1.

The discharge period includes at least the address period 50 for selecting a discharge cell intended for light emission, and the light-emission period 51 for generating light by discharge by applying pulse voltages alternately to the X electrode and the Y electrode as shown in FIGS. 17A to 17C.

Within the address period 50, the switch 211 is connected to the address driving circuit 209, and thereby the wall voltage Vw (V) is generated between the X and Y electrodes of the discharge cell intended for light emission by discharge during the subsequent light-emission period 51 as in the case of the prior art.

In this way, the discharge intended for light emission during the light-emission period 51 is selected.

Voltages are applied between the X and Y electrodes and between the A-electrode 29 and the X and Y electrodes within the light-emission period 51 such that only the intended cell is caused to discharge and emit light only when the above-explained wall voltages are present between the X and Y electrodes and between the A-electrode 29 and the X and Y electrodes within the light-emission period 51.

FIG. 1A illustrates waveforms of the discharge sustain voltages applied to the X and Y electrodes at the same time within the light-emission period 51 shown in FIG. 17A.

The Y electrode is supplied with a pulse drive driving voltage of V3 (V) in magnitude having a waveform 58, and the X electrode is supplied with a pulse driving voltage of V3 (V) in magnitude having a waveform 59.

Pulses of the magnitude V3 are applied alternately to the X electrode and the Y electrode, and as a result reversal of the polarity of the voltage between the X and Y electrodes is repeated.

The magnitude V3 is selected such that the presence and absence of the wall voltage generated by the address discharge correspond to the presence and absence of the sustain discharge.

During the light-emission period 51, the switch 211 is connected to the coil 210, and thereby the A-electrode 29 is connected to ground via the coil 210.

Ringing is caused in the voltage on the A-electrode mainly by a capacitance between the X and Y electrodes and the A-electrode 29 and an inductance of the coil 210 of the PDP 201.

As a result, a voltage of waveform 250 having a peak value V6, oscillating with ground potential as a center and decaying with time is applied to the A-electrode 29 as shown at the bottom of FIG. 1A where the peak voltage 254 is caused by ringing at the rise of the discharge sustain pulse and the peak voltage 255 is caused by ringing at the fall of the discharge sustain pulse.

FIG. 1B illustrates a wave form of Xe 823 nm light emission (light emission of 823 nm in wavelength from excited Xe elements) during the light-emission period 51.

Predischarges 252 are caused within the intervening periods 251 when both the X electrode and the Y electrode are at ground potential.

It is thought that the predischarge 252 is caused by a difference between a peak voltage 256 of a decaying oscillating voltage appearing on the A-electrode 29 in synchronism with the fall of the discharge sustain voltage and the wall voltage on a cathode which is one of the X and Y electrodes and reinforcement by priming particles.

Immediately after this, in synchronism with the rise of the discharge sustaining voltage, an electric field in the vicinity of the cathode becomes strong momentarily due to a peak voltage 254 appearing on the A-electrode 29, and thereby the main discharge 253 is caused.

However, the voltage on the A-electrode 29 decays rapidly, accordingly the electric fields weaken rapidly in the vicinity of locations where plasma has been created, therefore the circumstances good for generation of Xe ultraviolet rays are produced, and consequently, the efficiency of generation of ultraviolet rays is improved.

In a discharge cell where the address discharge has been caused, the discharge is started by the first voltage pulse, and continues until wall charges of the opposite polarity are accumulated to some extent.

The wall voltage accumulated due to the above discharge serves to reinforce the second voltage pulse of the opposite polarity, and consequently discharge is started again.

The above sequence is repeated by the third and succeeding voltage pulses.

In this way, in the discharge cell where the address discharge has occurred, sustain discharges occur between the X and Y electrodes the number of times equal to the number of the applied voltage pulses and emit light. On the other hand, the discharge cells do not emit light where the address discharge has not occurred.

In other words, even if the voltage 256 is applied to the A-electrode 29 in synchronism with the fall of the discharge sustain voltage, the predischarge is not caused without the wall voltage of the cathode in spite of the reinforcement by priming particles. And immediately after this, even if the peak voltage 254 appears on the A-electrode 29 in synchronism with the rise of the discharge sustain voltage, the electric fields in the vicinity of the cathode do not become so much unless the wall voltage is not formed on the cathode, and the main discharge 253 is not caused, either.

Figure 3A:
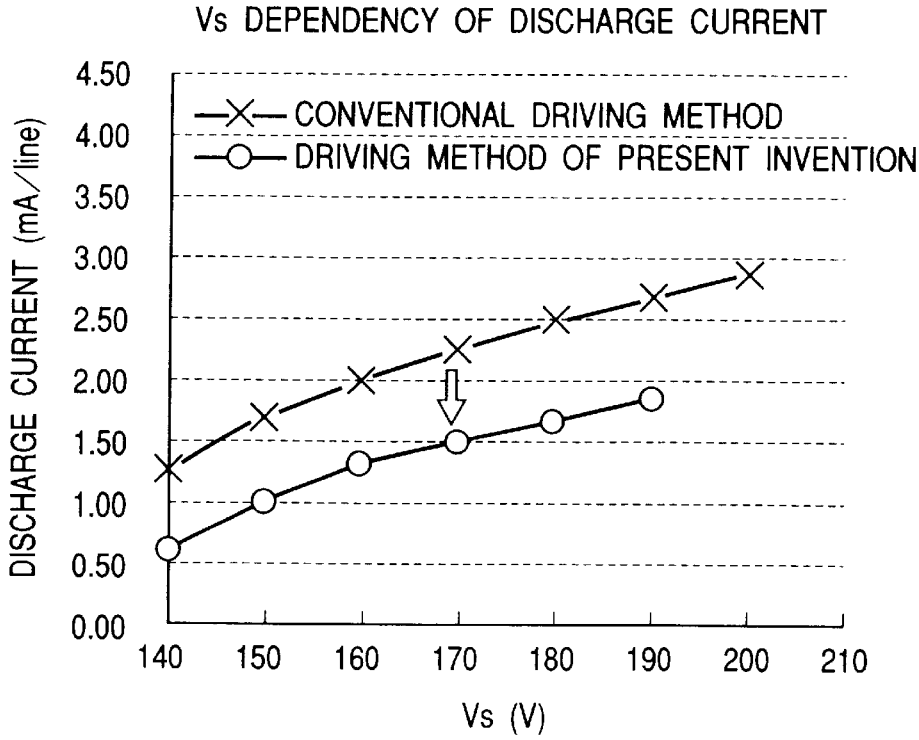
FIGS. 3A to 3C are graphs showing comparisons in discharge light-emission characteristics between the PDP of Embodiment 1 of the present invention and the prior art PDP.
Figure 3B:
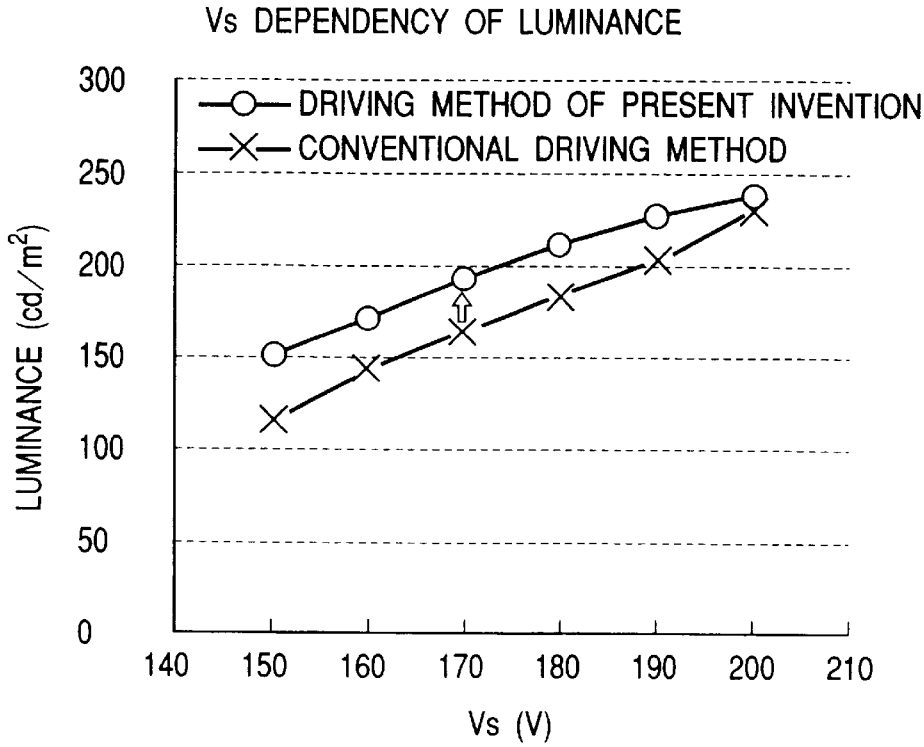
Figure 3C:
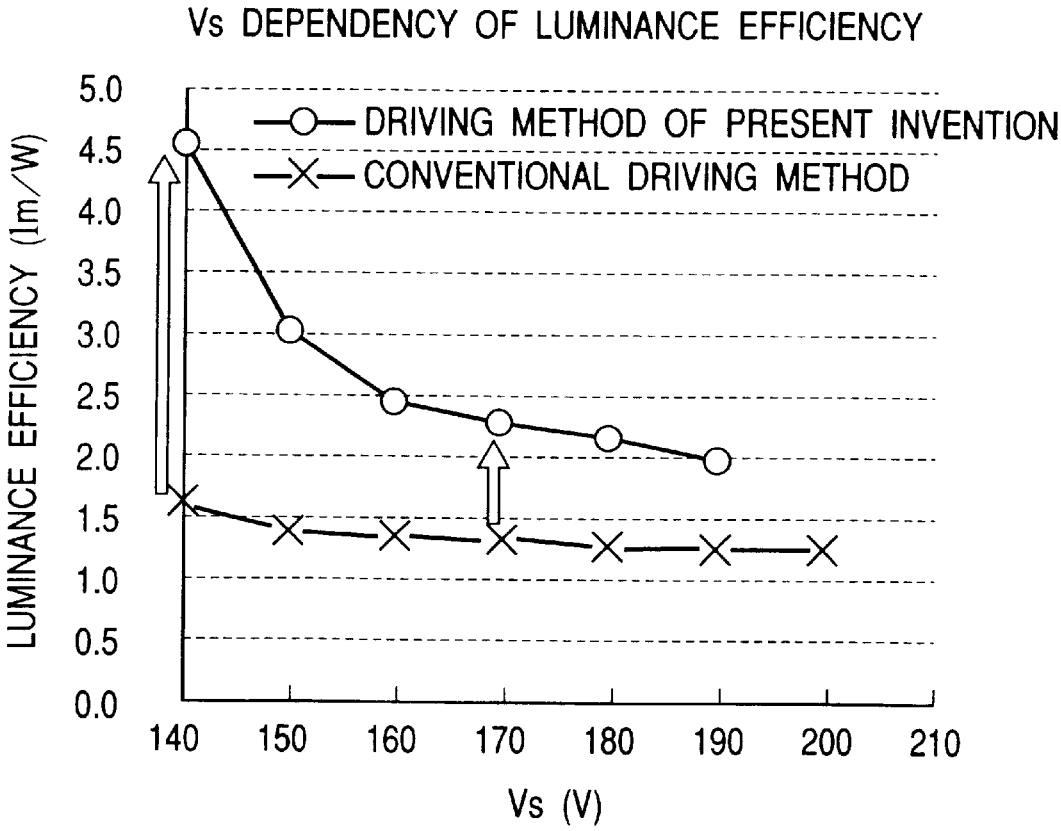

FIGS. 3A to 3C are graphs showing comparisons of driving voltage dependencies of discharge currents, luminance and luminous efficiencies between the driving methods of the present invention and the prior art, respectively.

Vs in FIGS. 3A to 3C denotes the magnitude V3 (V) of the pulse driving voltage applied to the X and Y electrodes within the light-emission period (see FIG. 1A).

Further, it is preferable for ensuring the beneficial effects of the present invention to satisfy the following relationship:

$$\text{the absolute value of } Va \leqq (1/10)Vs,$$

where

Vs=the magnitude V3 of the pulse driving voltage applied to the X and Y electrodes, and Va=the peak value V6 of the voltage on the A-electrode 29.

As is apparent from FIGS. 3A to 3C, the driving method in accordance with the present invention is capable of reducing the discharge currents, increasing luminance and improving the luminous efficiency compared with the prior art.

As described above, in this embodiment, in synchronism with the rise of the discharge sustaining voltage, the electric field in the vicinity of the cathode becomes strong momentarily due to the peak voltage 254 appearing on the A-electrode 29, and immediately after the main discharge 253 is caused, the voltage on the A-electrode 29 reduces, thereby weakening the electric fields rapidly in the vicinity of locations where plasma has been created and making possible the highly efficient generation of the Xe ultraviolet rays, and consequently, this embodiment provides an advantage of improving the efficiency of generation of ultraviolet rays.

Further this embodiment provides another advantage of realizing the driving method of the present invention with small modifications made on the prior art driving method.

In this embodiment, the coil 210 of about 1 $\mu$H in inductance was used for a 42-inch diagonal VGA panel, and it was confirmed that the coil 210 having an inductance in a range of 0.1 $\mu$H to 10 $\mu$H provides the similar beneficial effects.

In FIG. 2, the coil was used as the inductance element 210, the inductance element 210 is not limited to coils, but an inductance inherent in wiring per se for the circuit may be utilized instead.

The optimum value of the inductance depends upon the size of the PDP 201, the size and structure of the discharge cell and others, and is not limited to the above-mentioned values. The point is that the maximum efficiency is obtained by selecting the coil 210 having the most suitable value of the inductance for the PDP 201, the cell structure and others.

It is necessary for ensuring the beneficial effects of the present invention that the inductance element 210 selected as above is connected in series with at least one of the A-electrodes 29 of the PDP 201.

Here "is connected in series with" means that at least a portion of a current Ia flowing through the at least one of the A-electrodes 29 flows the inductance element 210.

Further, to ensure the beneficial effects of the present invention, it is desirable that at least 10% of the current Ia is designed to flow through the inductance element 210 during at least a portion of the light-emission period. However, the proportion of the current flowing the inductance element 210 to the current Ia depends upon the size of the PDP 201, the size and structure of the discharge cell and others, and is not limited to the above-mentioned values.

In the above explanation, the predischarge 252 occurred before the main discharge 235. However, the beneficial effects of the present invention are obtained even under a condition that little or no predischarge is caused to occur by reducing the magnitude V3 of the discharge sustaining voltage or other methods.

The switch 211 is used to connect the coil 210 in series with the A-electrode 29 within the light-emission period only, and is employed as a means for ensuring the more stable addressing operation.

However, it is not always necessary that the A-electrode 29 is connected in series with the coil 210 during the entire light-emission period via the switch 211, but the A-electrode 29 may be connected in series with the coil 210 during at least a portion of the light-emission period required to obtain the beneficial effects of the present invention.

Further, it is not always necessary that the A-electrode 29 is connected to the address driving circuit 209 via the switch 211 during the entire period other than the light-emission period, but the A-electrode 29 may be connected to the address driving circuit 209 via the switch 211 during at least a portion of the entire period other than the light-emission period required to obtain the beneficial effects of the present invention and secure the normal operation.

Therefore the switch 211 is not indispensable, and the beneficial effects of the present invention is obtained even if the switch 211 is eliminated under an operable condition, but in this case the coil 210 needs to be provided for each of the A-electrodes 29 as shown in FIG. 2C.

Further, in this embodiment, the voltages Vs and Va have been described as positive values, but the beneficial effects of the present invention are obtained even when the voltages Vs and Va are negative values.

Further, it is needless to say that the present application is also applicable to a case where the polarity and value of the voltage of Vs vary with pulses.

Embodiment 2

Figure 4:
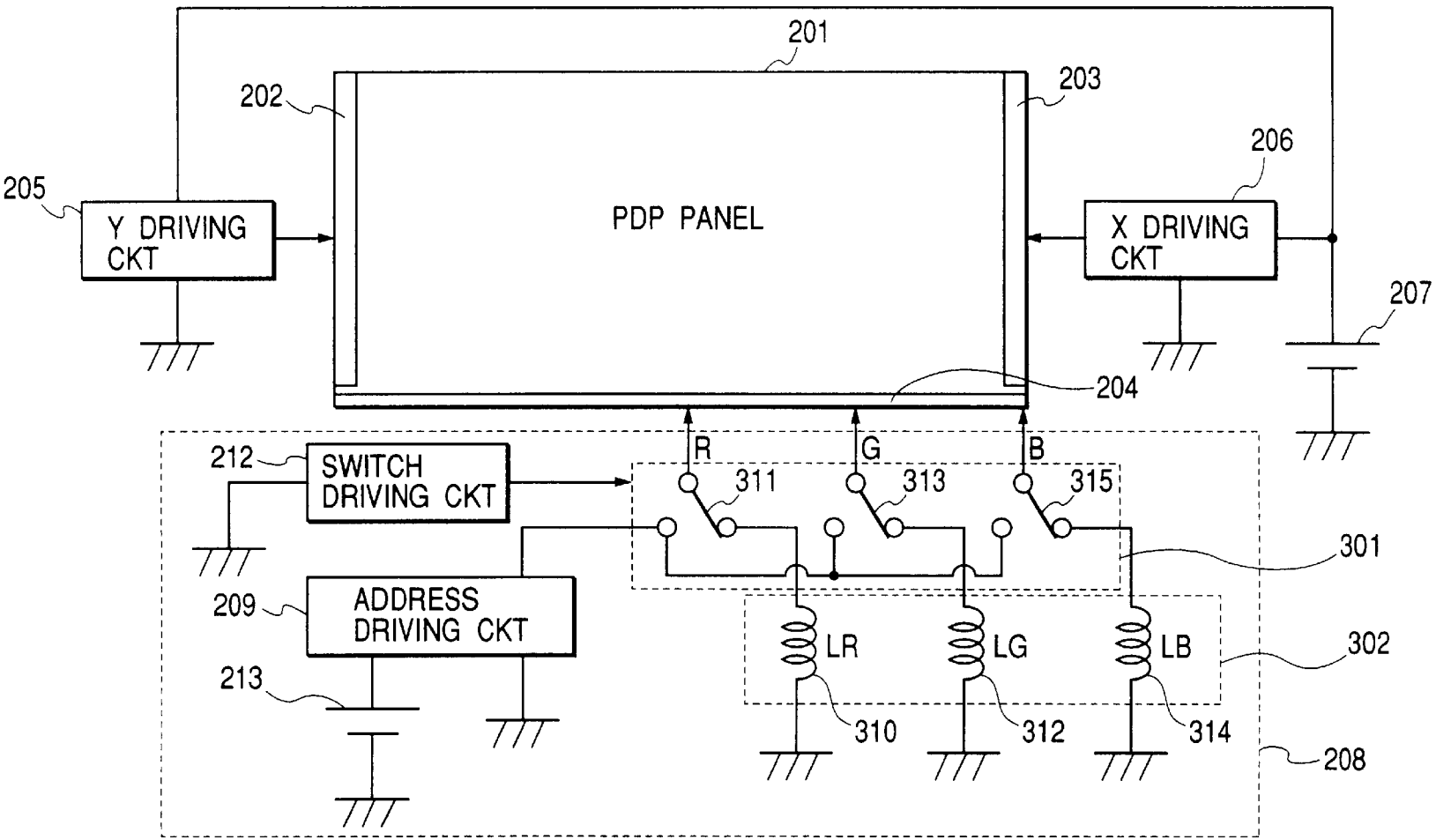
FIG. 4 is a block diagram illustrating a rough configuration of a plasma display device of Embodiment 2 of the present invention.

FIG. 4 is a block diagram illustrating a rough configuration of a plasma display device in accordance with Embodiment 2 of the present invention.

Embodiment 2 differs from Embodiment 1, in that a switch 301 and a coil 302 are divided into three portions corresponding to three primary colors of red (R), green (G) and blue (B).

As shown in FIG. 4, in Embodiment 2, a pair of a coil 310 of an inductance LR and a switch 311, a pair of a coil 312 of an inductance LG and a switch 313, and a pair of a coil 314 of an inductance LB and a switch 315 are provided for red discharge cells, green discharge cells and blue discharge cells, respectively.

An amplitude and a period of ringing of a voltage appearing on the A-electrode 29 depend upon an inductance of the coil and a capacitance between the A-electrode 29 and the X and Y electrodes of the PDP 201.

The efficiency of generation of ultraviolet rays depends upon the amplitude and the period of the ringing, and therefore the inductance of the coil is selected to provide the maximum efficiency of generation of ultraviolet rays for each of the primary colors. Consequently, in this embodiment, the efficiency is further improved. Color temperatures and deviations of reproduced white from intended white can be adjusted by selecting the proper inductance of the coil for each color.

In this embodiment also, one coil 210 can be provided for all the A-electrodes 29 of the red discharge cells in common as shown in FIG. 2B, or one coil 210 can be provided for each of the A-electrodes 29 of the red discharge cells as shown in FIG. 2C. This applies to the green and blue discharge cells.

Embodiment 3

Figure 5:
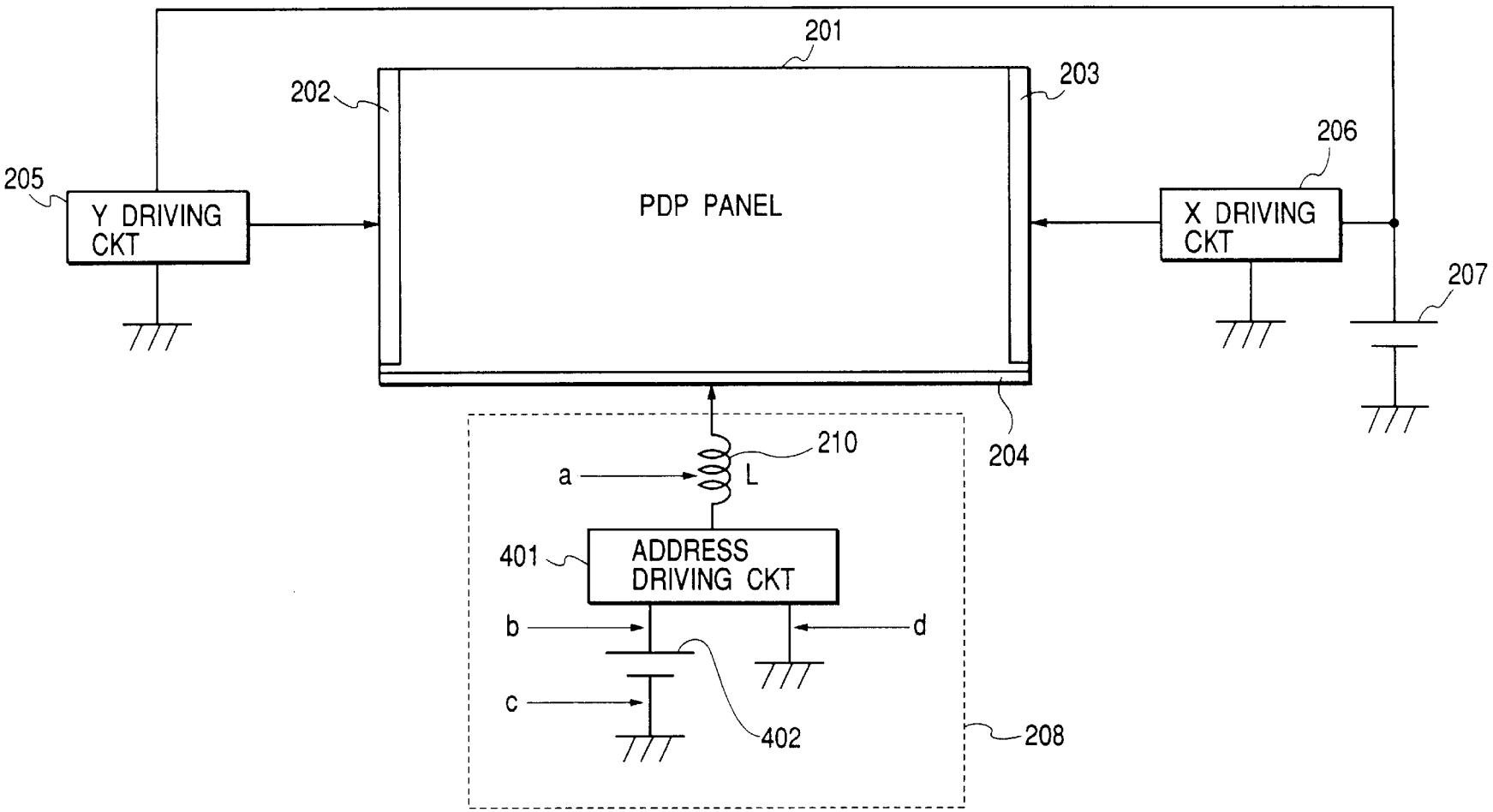
FIG. 5 is a block diagram illustrating a rough configuration of a plasma display device of Embodiment 3 of the present invention.

FIG. 5 is a block diagram illustrating a rough configuration of a plasma display device in accordance with Embodiment 3 of the present invention.

Embodiment 3 differs from Embodiment 1, in that the switch 211 and the switch driving circuit 212 are omitted, and the coil 210 is connected directly to the address driving circuit 401 receiving a voltage or a power from the power source 402. However, in this embodiment, one coil 210 needs to be provided for each of the A-electrodes 29 as shown in FIG. 2C.

In FIG. 5, the coil 210 is disposed at location a, but the similar beneficial effects are obtained by locating the coil 210 at at least one of locations a, b, c and d.

In this embodiment, ringing occurs during the address period also, but selection and non-selection of a discharge cell are performed by choosing the appropriate address voltage magnitude V0.

In this way, in this embodiment, the efficiency of generation of ultraviolet rays can be improved by using a simpler circuit configuration.

Embodiment 4

Figure 6:
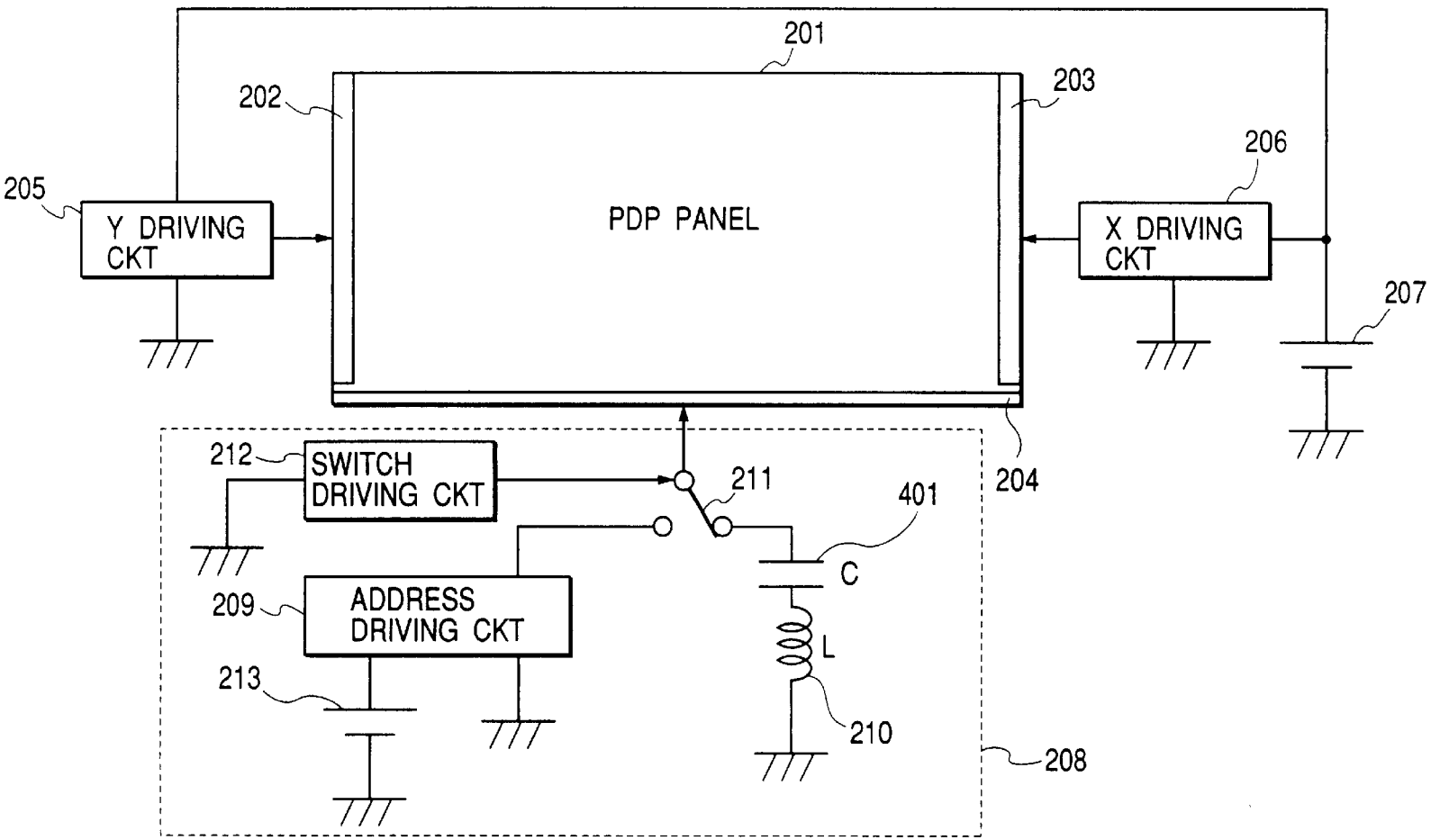
FIG. 6 is a block diagram illustrating a rough configuration of one example of a plasma display device of Embodiment 4 of the present invention.

FIG. 6 is a block diagram illustrating a rough configuration an example of a plasma display device in accordance with Embodiment 4 of the present invention.

Figure 7:
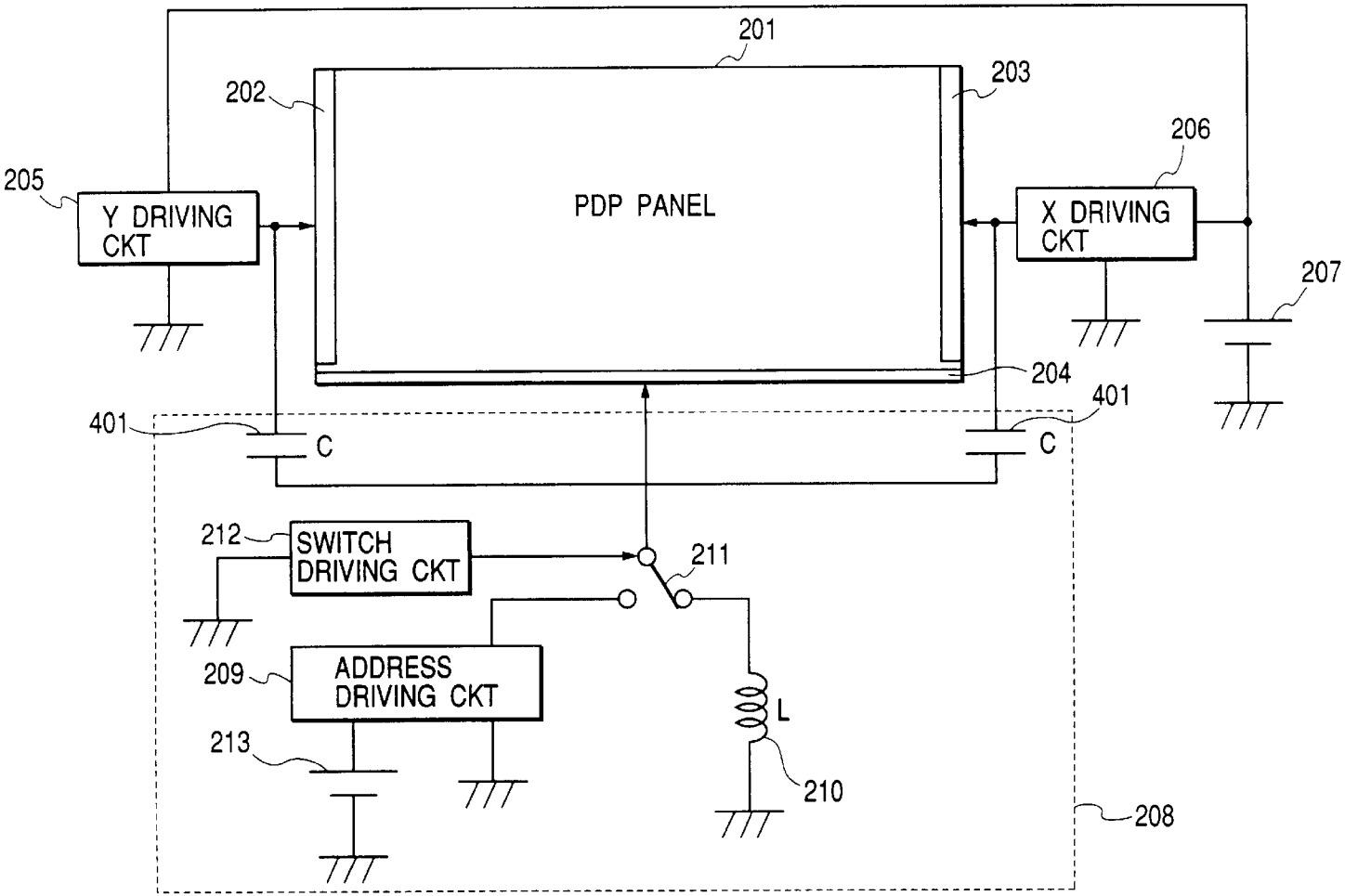
FIG. 7 is a block diagram illustrating a rough configuration of another example of the plasma display device of Embodiment 4 of the present invention.

FIG. 7 is a block diagram illustrating a rough configuration of another example of a plasma display device in accordance with Embodiment 4 of the present invention.

The plasma display device shown in FIG. 6 differs from Embodiment 1, in that a capacitance element (a condenser) 401 is connected in series with the coil 210, and the plasma display device shown in FIG. 7 differs from Embodiment 1, in that a capacitance element 401 is connected in parallel with a capacitance between the discharge sustain electrode pair and the A-electrode 29 of the PDP 201.

With this configuration, a period and an amplitude of a ringing voltage appearing on the A-electrode 29 can be adjusted so as to increase the efficiency of generation of ultraviolet rays when the capacitance of the PDP 201 is excessively large (the case of FIG. 6) or when the capacitance of the PDP 201 is excessively small (the case of FIG. 7).

In this way, in this embodiment, even if the capacitance of the PDP 201 is excessively large or excessively small, the efficiency of generation of ultraviolet rays can be improved.

Embodiment 5

Figure 8A:
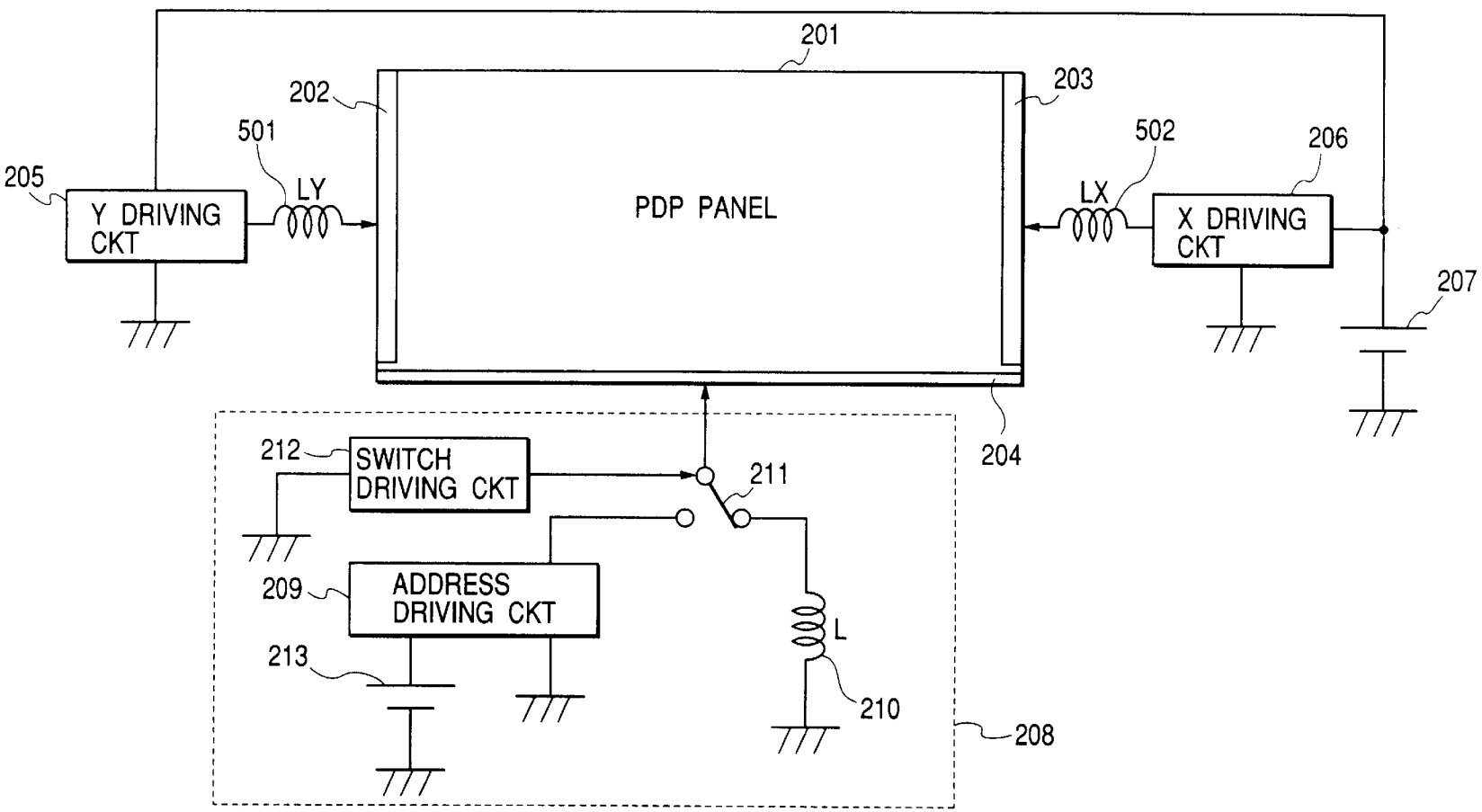
FIG. 8A is a block diagram illustrating a rough configuration of a plasma display device of Embodiment 5 of the present invention.

FIG. 8A is a block diagram illustrating a rough configuration of a plasma display device in accordance with Embodiment 5 of the present invention.

Embodiment 5 differs from Embodiment 1, in that coils 501 and 502 are connected to the Y-electrode terminal portion 202 and the X-electrode terminal portion 203, respectively.

Figure 8B:
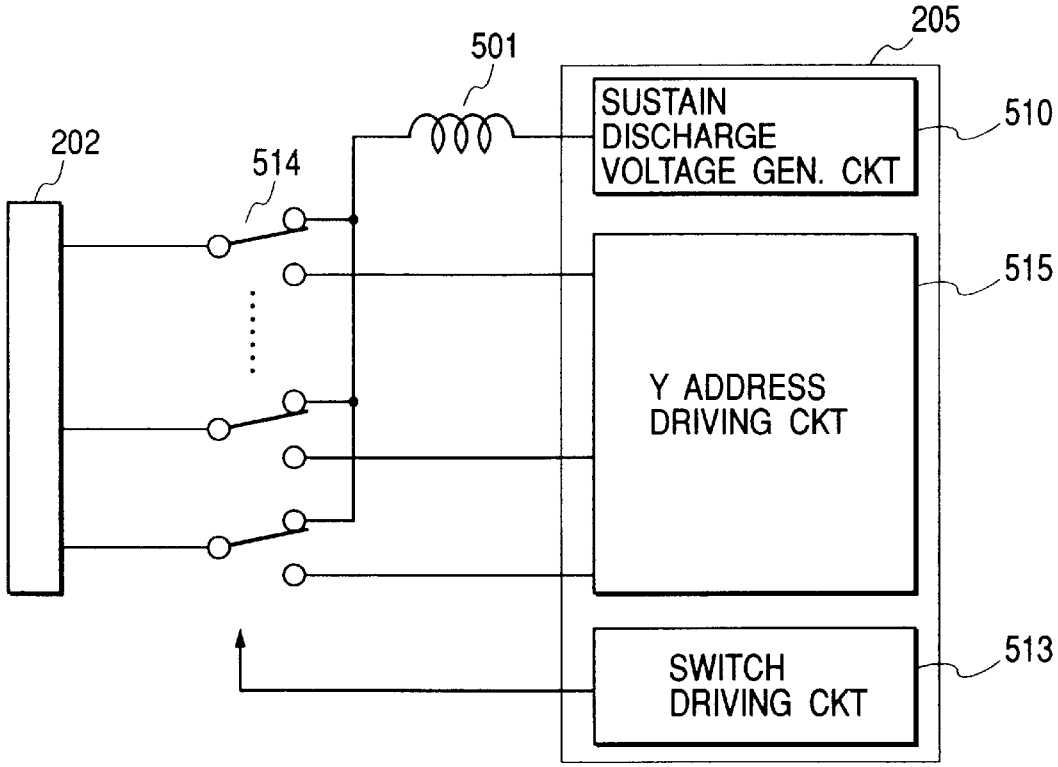
FIG. 8B is a circuit configuration of Embodiment 5 for an inductance element.

FIG. 8B shows an example of a circuit configuration. The coil 501 is connected in series with a sustain discharge voltage generator circuit 510 within a Y driving circuit 205, and switches 514 are controlled by a switch driving circuit 513 such that the coils 501 are connected in series with the Y electrodes within the light-emission period and the Y electrodes are connected to a Y address driving circuit 515 during a period other than the light-emission period.

Figures 9A, 9B:
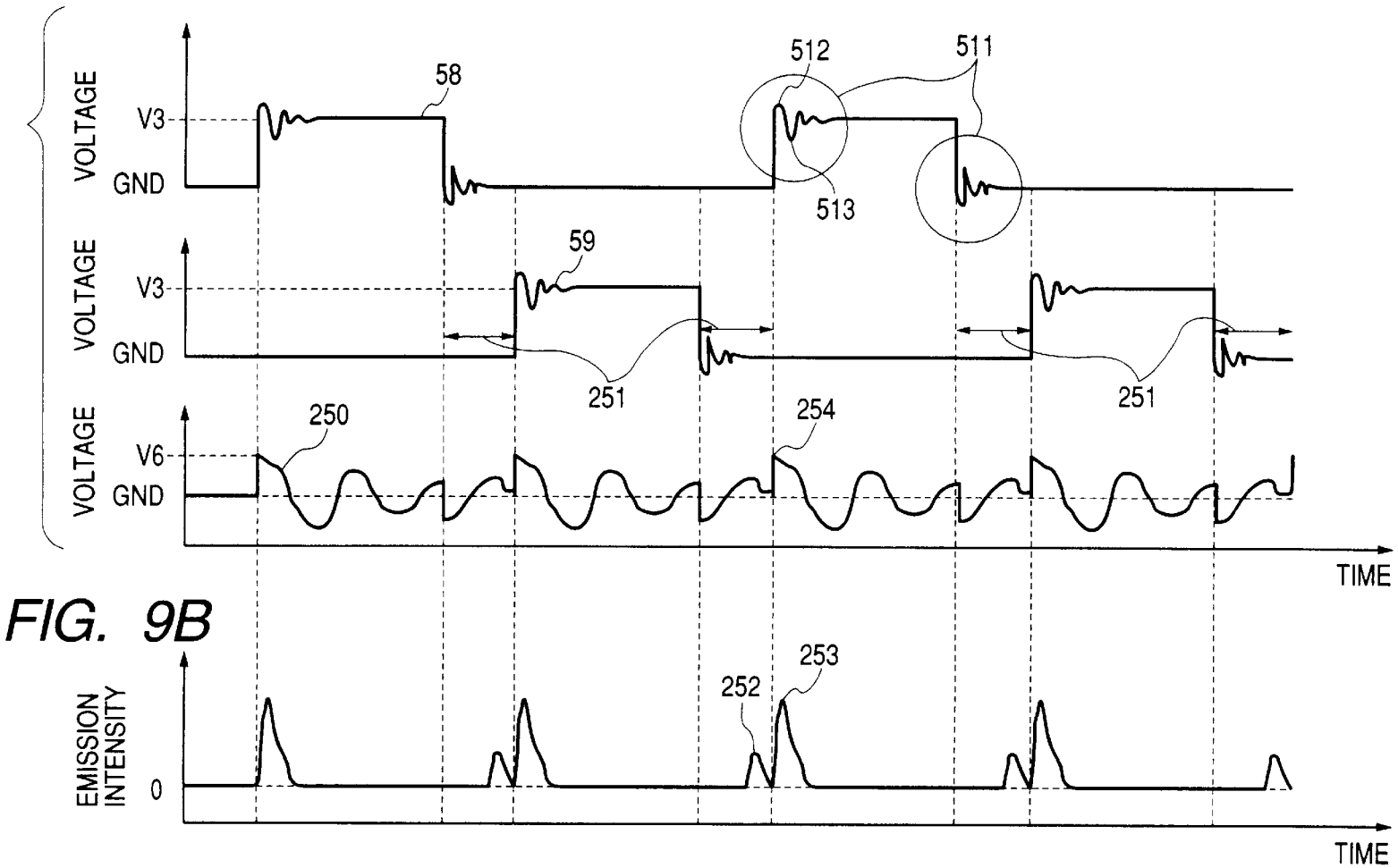
FIG. 9A illustrates a voltage sequence for a PDP of the plasma display device of Embodiment 5 of the present invention.
FIG. 9B illustrates a waveform of Xe 823 nm light emission (light emission of 823 nm in wavelength from excited Xe elements)

In this embodiment, ringing 511 occurs in a voltage on the Y electrode within the light-emission period as shown in FIG. 9A.

This ringing is caused mainly by a capacitance between the X and Y electrodes of the PDP and the coils 501 and 502.

The electric fields in the vicinity of the cathode becomes stronger than in Embodiment 1, due to occurrence of a peak voltage 512 of the discharge sustaining voltage in addition to a peak voltage 254 appearing on the A-electrode 29, in synchronism with rise of the discharge-sustaining voltage (see FIG. 9A), and consequently, the main discharge 253 occurs more rapidly (see FIG. 9B).

However, the voltage on the A-electrode 29 decreases rapidly, and moreover the discharge sustaining voltage decreases as indicated by a voltage 513 in FIG. 9A. Consequently, the electric fields weaken more rapidly in the vicinity of locations where plasma has been created, therefore the circumstances good for generation of Xe ultraviolet rays are produced, and as a result, the efficiency of generation of ultraviolet rays is improved further.

In this way, in this embodiment, in addition to the occurrence of the ringing in the voltage appearing on the A-electrode 29, the ringing occurs in the discharge sustain voltage, and therefore if the ringing in the discharge sustain voltage occurs with the same period as that of the ringing on the A-electrode, their synergism can improve the efficiency of generation of ultraviolet rays further.

Embodiment 6

Figure 10:
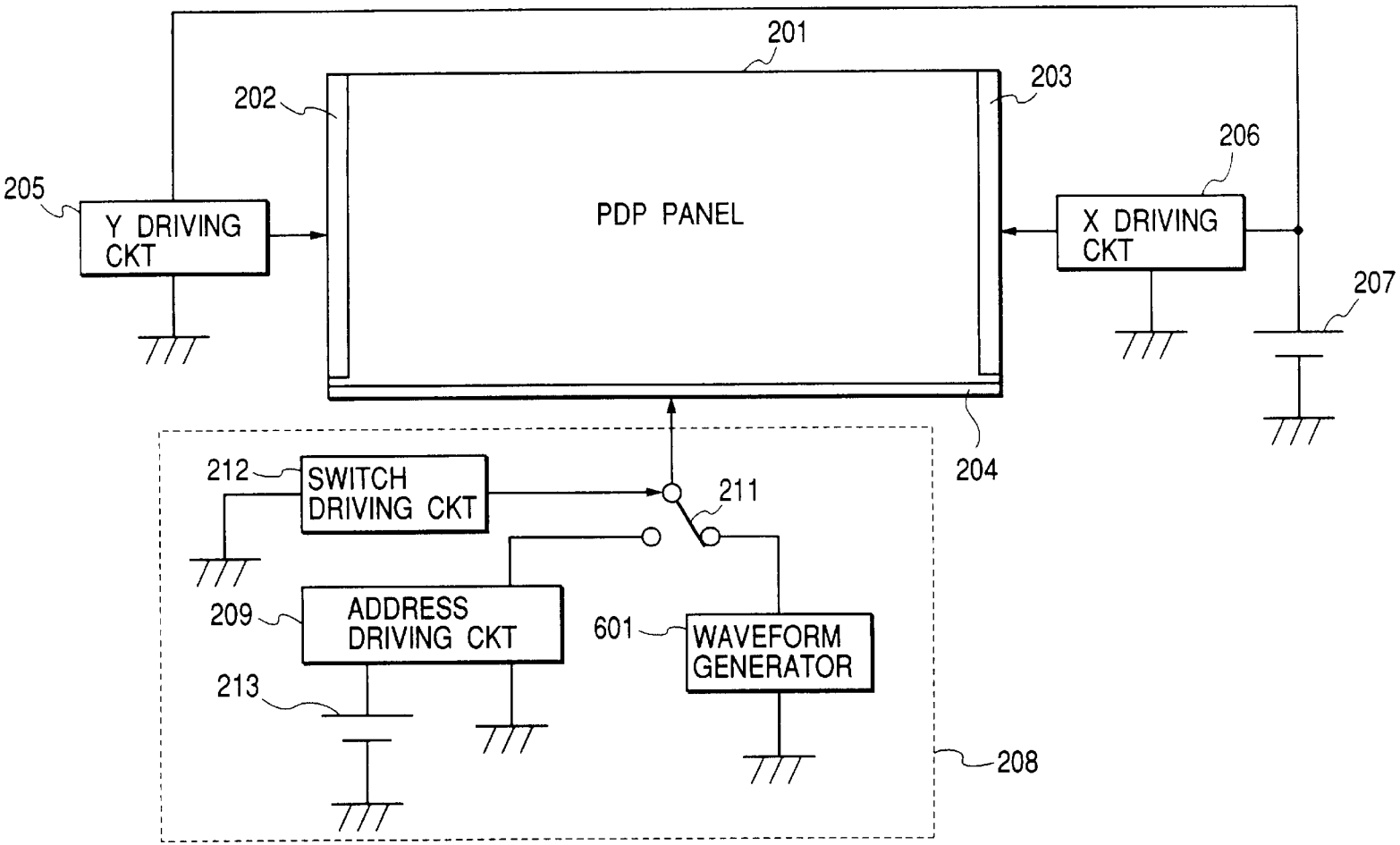
FIG. 10 is a block diagram illustrating a rough configuration of a plasma display device of Embodiment 6 of the present invention.

FIG. 10 is a block diagram illustrating a rough configuration of a plasma display device in accordance with Embodiment 6 of the present invention.

Embodiment 6 differs from Embodiment 1, in that a waveform generator 601 is provided to apply the above-described drive driving voltage to the A-electrode 29.

With this configuration, normal addressing is performed within the address period and the required voltage waveform is applied to the A-electrode 29 within the light-emission period.

Figures 11A, 11B:
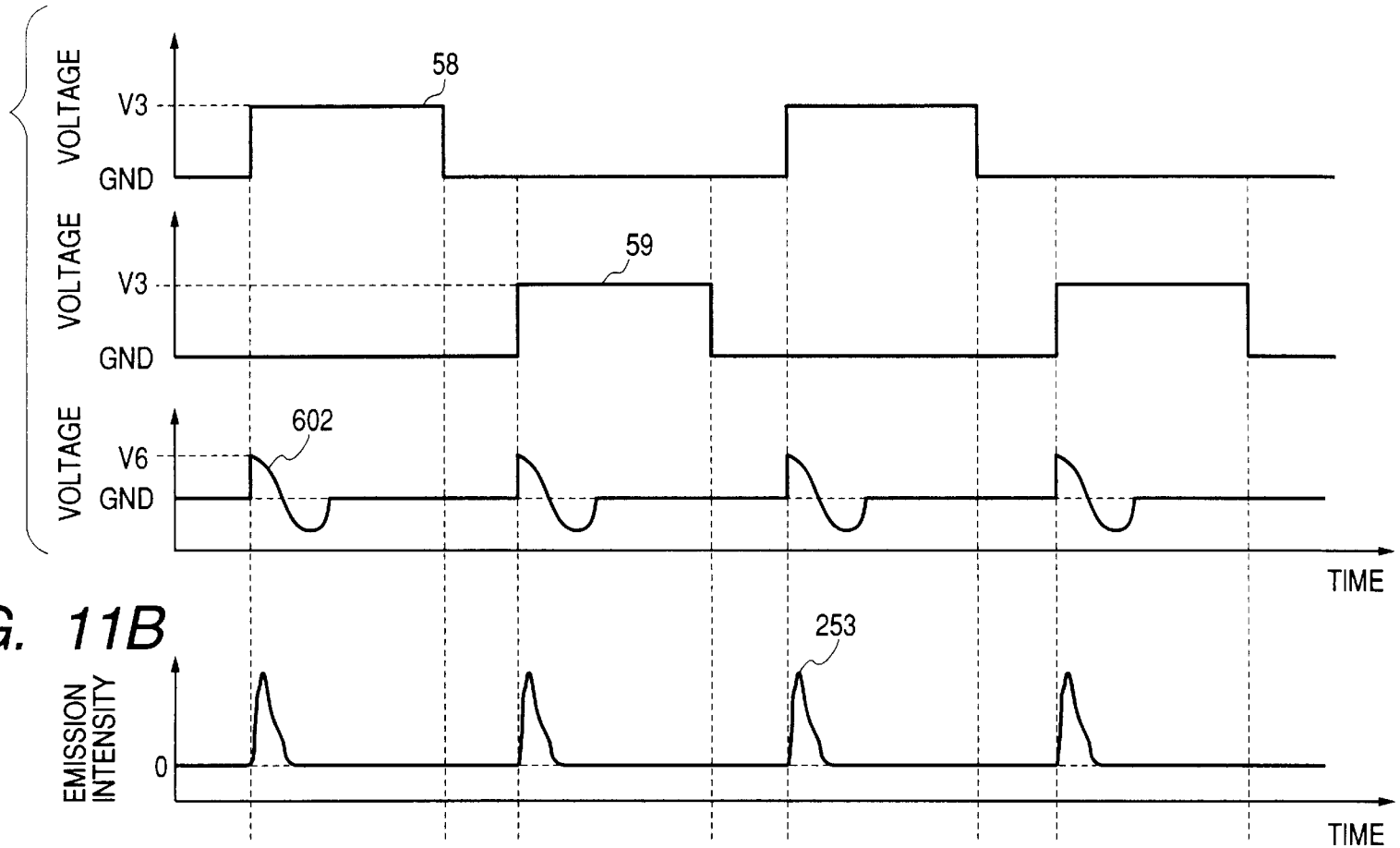
FIG. 11A illustrates a voltage sequence for a PDP of the plasma display device of Embodiment 6 of the present invention.
FIG. 11B illustrates a waveform of Xe 823 nm light emission.

For example, if a voltage 602 as shown in FIG. 11A is applied to the A-electrode 29, light emission can be obtained without predischarge as shown in FIG. 11B.

The voltage waveform applied to the A-electrode 29 during the main discharge is similar to that in the above Embodiments, and therefore the efficiency of generation of ultraviolet rays can be improved.

Another advantage of good controllability is obtained because the waveform generator 601 is used.

This waveform generator 201 is provided for each of the A-electrodes 29 as in the case of FIG. 2B.

Figure 12:
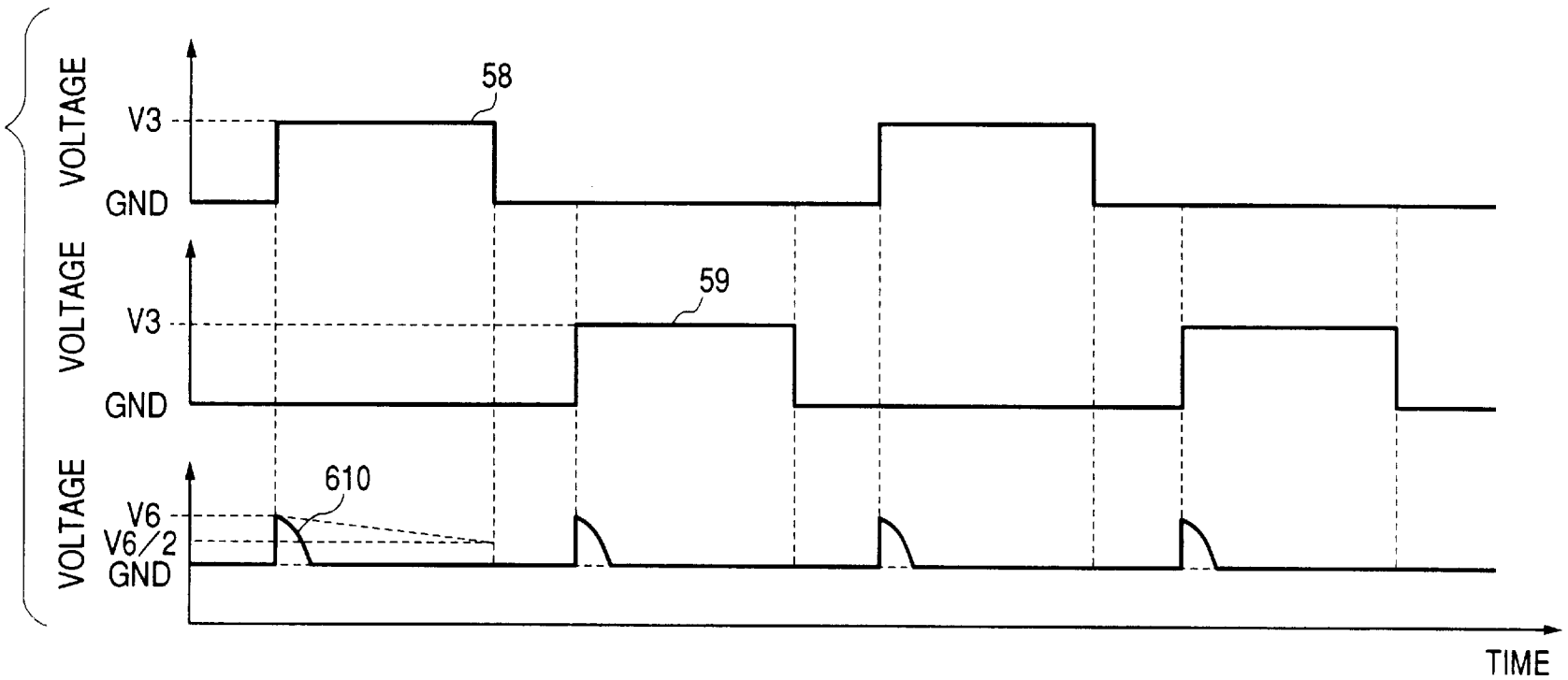
FIG. 12 illustrates another voltage sequence for the PDP of the plasma display device of Embodiment 6 of the present invention.
Figure 13:
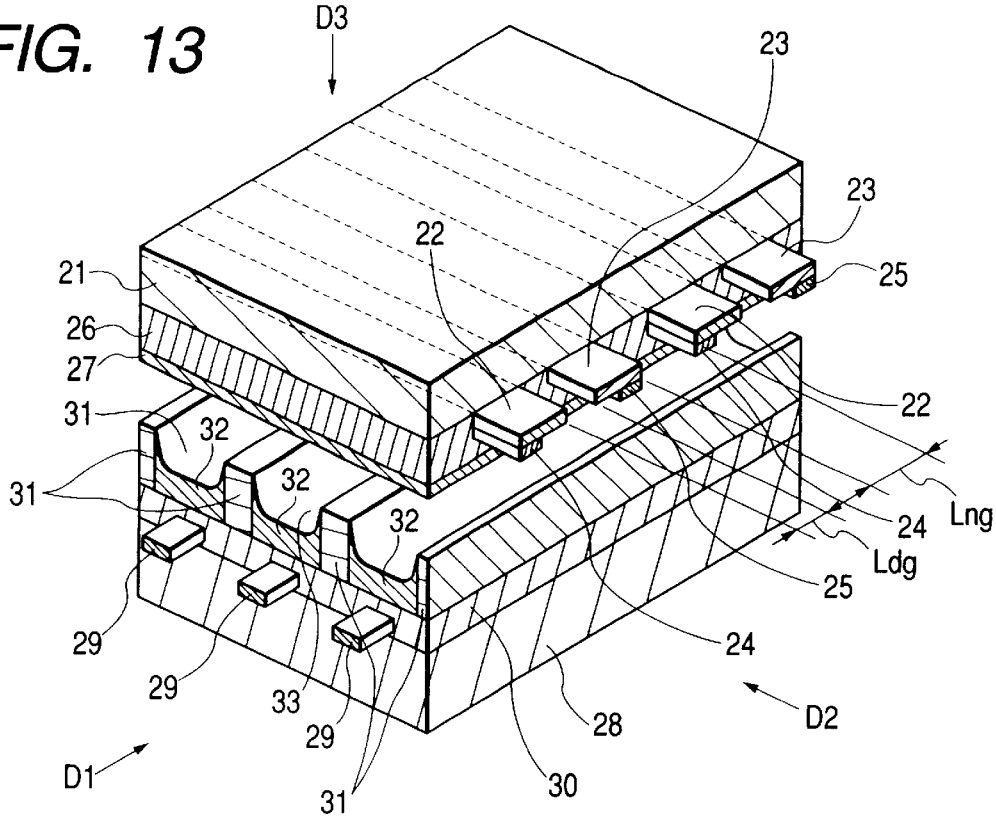
FIG. 13 is a fragmentary exploded perspective view of a prior art three-electrode AC surface-discharge PDP.
Figure 14:
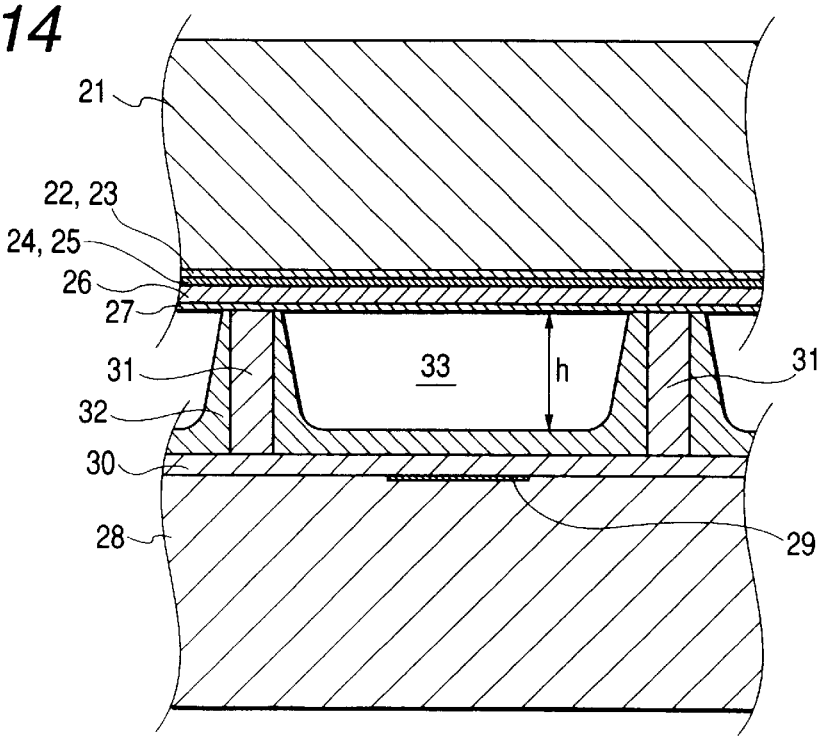
FIG. 14 is a cross-sectional view of the PDP viewed in the direction of the arrow D1 of FIG. 13.
Figure 15:
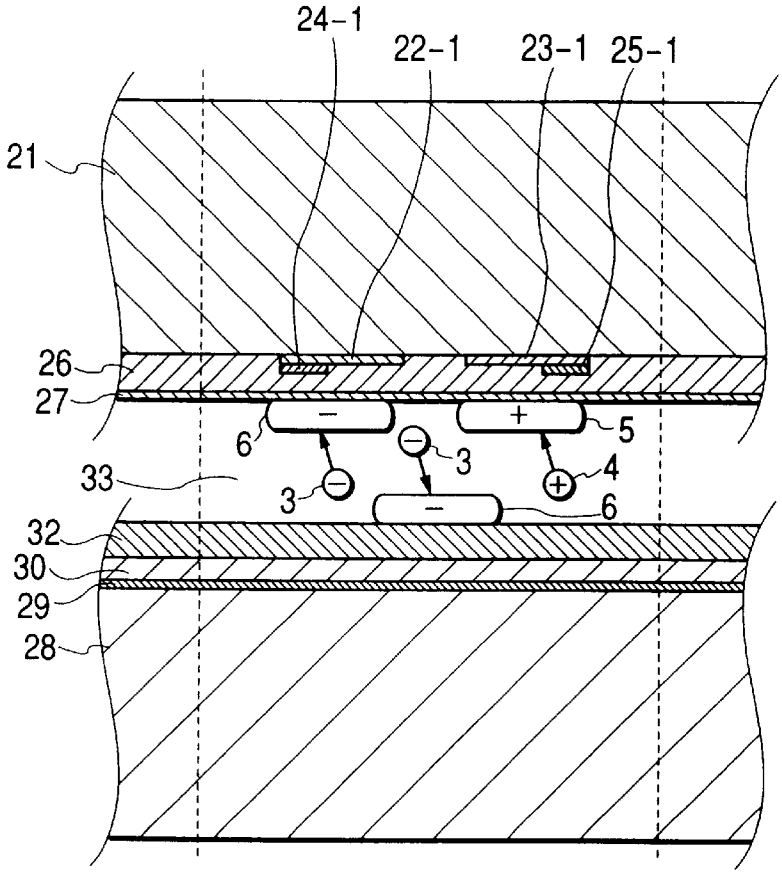
FIG. 15 is a cross-sectional view of the PDP viewed in the direction of the arrow D2 of FIG. 13.
Figure 16:
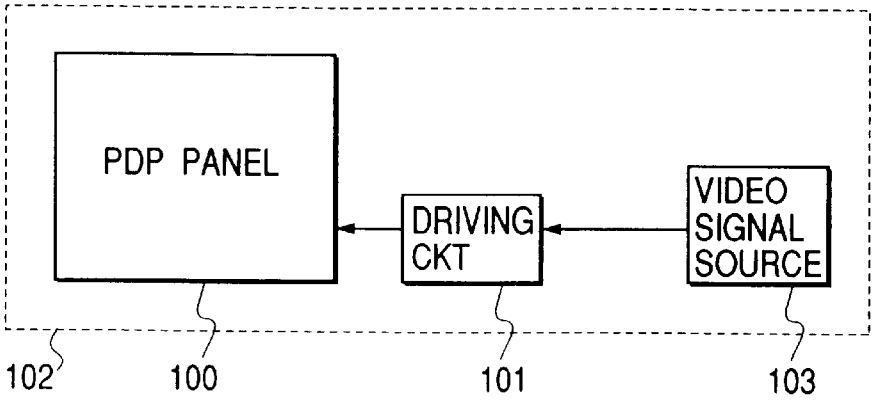
FIG. 16 is a block diagram illustrating a rough configuration of a prior art plasma display device.

A voltage waveform 610 as shown in FIG. 12 can be applied to the A-electrode 29 instead of the voltage waveform 602 shown in FIG. 11A to obtain the similar advantages.

The voltage waveform 610 shown in FIG. 12 rises rapidly to the voltage V6 in synchronism with rise of the discharge sustaining voltage, and then decays rapidly to the initial voltage (ground potential GND in the case of FIG. 12). The above-described advantages of the present invention can be obtained if the decaying waveform is such that the voltage falls to (½)V6 or less before the discharge sustain voltage falls to ground potential GND as indicated by broken lines in FIG. 12, for example.

Further, in the above-described embodiments, the discharge sustain voltages have been described as pulse driving voltages varying between the ground potential GND and the positive voltage V3, but the present invention is also applicable to a case where the discharge sustain voltage is a pulse driving voltage varying between the ground potential GND and the negative voltage (−V3).

In this case also, electric fields in the vicinity of the anode which is one of the X and Y electrodes become strong momentarily due to the peak voltage of a decaying oscillating voltage appearing on the A-electrode 29 in synchronism with fall of the discharge sustaining voltage, and as a result the main discharge 253 occurs.

However, the voltage on the A-electrode 29 decreases rapidly, thereby the electric fields weaken rapidly in the vicinity of locations where plasma has been created, therefore the circumstances good for generation of Xe ultraviolet rays are produced, and as a result, the efficiency of generation of ultraviolet rays is improved.

Further, the present invention includes all of possible combinations of the above embodiments.

The invention made by the present inventors has been explained concretely based upon the above embodiments, but the present invention is not limited to the above embodiments, and changes and modifications may be made without departing from the nature and spirit of the invention.

The beneficial effects obtained by the representative ones of the present invention disclosed in the specification can be summarized as follows:

In the present invention, ultraviolet rays are generated efficiently and consequently, the efficiency of the plasma display panel can be improved.

What is claimed is:

1. A plasma display device comprising:

a plasma display panel having a pair of opposing base plates and a plurality of discharge cells formed between said pair of opposing base plates, each of said plurality of discharge cells having a pair of discharge sustain electrodes disposed on one of said pair of opposing base plates and an address electrode disposed on another of said pair of opposing base plates; and a driving circuit for driving said plurality of discharge cells, said driving circuit being configured such that at least one of said pair of discharge sustain electrodes is supplied with a pulse driving voltage within a period of light emission of a corresponding one of said plurality of discharge cells, an address electrode of at least one of said plurality of discharge cells is supplied with a driving voltage within said period of light emission, said driving voltage having a waveform including a portion varying to a voltage level Va in synchronism with variation from a first voltage level to a second voltage level of said pulse driving voltage and then varying to a voltage level Vb before said pulse driving voltage varies from said second voltage level to said first voltage level, an absolute value of said voltage level Vb not being greater than an absolute value of half said voltage level Va.

2. A plasma display device according to claim 1, wherein discharge is generated in said at least one of said plurality of discharge cells within a period of said first voltage level of said pulse driving voltage.

3. A plasma display device according to claim 1, comprising at least one inductance element used in supplying at least a portion of the driving voltage to all address electrodes.

4. A plasma display device according to claim 1, comprising a plurality of inductance elements, where each inductance element is used in supplying at least a portion of the driving voltage to a differing group of address electrodes.

5. A plasma display device according to claim 1, comprising a plurality of inductance elements, where each inductance element is used in supplying at least a portion of the driving voltage to a different address electrode.

6. A plasma display device comprising:

a plasma display panel having a pair of opposing base plates and a plurality of discharge cells formed between said pair of opposing base plates, each of said plurality of discharge cells having a pair of discharge sustain electrodes disposed on one of said pair of opposing base plates and an address electrode disposed on another of said pair of opposing base plates;

a driving circuit for driving said plurality of discharge cells, said driving circuit being configured such that at least one of said pair of discharge sustain electrodes is supplied with a pulse driving voltage within a period of light emission of a corresponding one of said plurality of discharge cells; and a switching circuit, wherein said switching circuit switches said address electrode of at least one of said plurality of discharge cells to said inductance element during at least a portion of said period of light emission, and switches said address electrode to a circuit of said driving circuit for driving said address electrode during at least a portion of a period of time other than said period of light emission such that said address electrode of said at least one of said plurality of discharge cells is supplied with a driving voltage within said period of light emission, said driving voltage having a waveform including a portion varying to a voltage level Va in synchronism with variation fro a first voltage level to a second voltage level of said pulse driving voltage and then varying to a voltage level Vb before said pulse driving voltage varies from said second voltage level to said first voltage level, an absolute value of said voltage level Vb not being greater than an absolute value of half of said voltage level Va.

7. A plasma display device according to claim 6, wherein said inductance element is a common inductance element used in supplying at least a portion of a driving voltage to all address electrodes.

8. A plasma display device according to claim 6, comprising a plurality of inductance elements, where each inductance element is used in supplying at least a portion of a driving voltage to a differing group of address electrodes.

9. A plasma display device according to claim 6, comprising a plurality of inductance elements, where each inductance element is used in supplying at least a portion of a driving voltage to a different address electrode.

10. A plasma display device comprising:

a plasma display panel having a pair of opposing base plates and a plurality of discharge cells formed between said pair of opposing base plates, each of said plurality of discharge cells having a pair of discharge sustain electrodes disposed on one of said pair of opposing base plates and an address electrode disposed on another of said pair of opposing base plates;

a driving circuit for driving said plurality of discharge cells, said driving circuit being configured such that at least one of said pair of discharge sustain electrodes is supplied with a pulse driving voltage within a period of light emission of a corresponding one of said plurality of discharge cells; and a waveform generator for supplying a driving voltage to an address electrode of at least one of said plurality of discharge cells within said period of light emission, wherein said driving voltage has a waveform including a portion varying to a voltage level Va in synchronism with variation from a first voltage level to a second voltage level of said pulse driving voltage and then varying to a voltage level Vb before said pulse driving voltage varies from said second voltage level to said first voltage level, and an absolute value of said voltage level Vb is not greater than an absolute value of half of said voltage level Va.

* * * * *